United States Patent [19]

Piontkowski

[11] Patent Number: 4,550,668

[45] Date of Patent: Nov. 5, 1985

[54] COMBUSTOR UNIT FOR WOODBURNING STOVE

[76] Inventor: Carl F. Piontkowski, 38 Ridge Dr., Old Saybrook, Conn. 06475

[21] Appl. No.: 509,794

[22] Filed: Jul. 1, 1983

[51] Int. Cl.[4] ..... F23B 5/00; B01D 46/42

[52] U.S. Cl. ..... 110/210; 110/203; 110/211; 126/285 R; 126/289; 126/291; 126/292; 55/422; 55/DIG. 30

[58] Field of Search ..... 126/312, 285 R, 290, 126/291, 292, 293, 295, 289, 77; 110/162, 210, 211, 203; 55/DIG. 30, 307, 422; 422/180

[56] References Cited

U.S. PATENT DOCUMENTS

| | | | |
|---|---|---|---|
| 2,993,454 | 7/1961 | Hebert | 110/211 |
| 4,279,629 | 7/1981 | Simms | 126/285 R X |
| 4,373,452 | 2/1983 | Van Dewoestine | 110/210 X |

*Primary Examiner*—Randall L. Green

[57] ABSTRACT

A combustor unit for a woodburning stove comprises a generally T-shaped flue assembly interiorly receiving a combustor having a catalyst to facilitate combustion of exhaust gases. The combustor is pivotal between a combustion position wherein the combustor is positioned across an exhaust passageway to an open position wherein the combustor is substantially removed from the exhaust gas stream and positioned within an access passageway.

18 Claims, 2 Drawing Figures

COMBUSTOR UNIT FOR WOODBURNING STOVE

BACKGROUND OF THE INVENTION

This invention relates to a combustor unit for a woodburning stove. More particularly, this invention relates to a combustor unit which employs a member having a catalyst for facilitating combustion of exhaust gases from a woodburning stove.

The increased popularity of woodburning stoves has reawakened interest in a number of the problems associated with the burning of wood. A critical problem in the use of woodburning stoves is the production of creosote and other pollutants resulting from the burning of wood. The build-up of creosote in the exhaust flues and chimneys of woodburning stoves produces an unpleasant odor, a potential for seepage from the exhaust conduits and, most of all, presents a potential for combustion and ultimately an uncontrolled fire. In addition to the safety and sanitary hazards presented by the burning of wood, increased emphasis has been directed to energy conversion, e.g., the obtaining of the largest quantity of useful heat from each unit of fuel.

The foregoing problems associated with woodburning stoves have been addressed by the employment of a combustor member in the path of the exhaust gases produced by a woodburning stove. Such combustor members typically are comprised of a ceramic porous material with a surface consisting of a noble metal catalyst. The combustor units function in a well-known and conventional manner by providing a catalyst wherein combustible materials in the exhaust gases, and in particular creosote forming gases, are ignited at a relatively low temperature, conventionally on the order of 500 degrees F. to 2000 degrees F., the heat generated by the woodburning stove being sufficient to ignite the exhaust gases.

While the use of such catalytic combustor units has proved useful in eliminating substantial quantities of creosote and in increasing the efficiency of the woodburning stove, there have previously been a number of limitations in the use of such catalytic combustors. For example, such catalytic combustor units over a period of operation become sites for the deposits of carbon ash residue and creosote residue. The carbon ash residue may be deposited on the combustor in such a manner that the combustor element is clogged and eventually becomes inoperative. The creosote residue may also clog the catalytic combustor over a period of time and prevent or interfere with proper functioning of the combustor unit. In order to repair or clean the combustor member, it has heretofore generally been necessary to remove the combustor member which removal usually requires disassembly of the exhaust flue. An additional problem associated with ceramic-type catalytic combustors is that these combustors are very susceptible to damage from thermal shock and flame impingement. If the combustor is exposed to colder air currents during the operation interval at approximately 500 degrees F. to 2000 degrees F. (such as by opening the door of the stove to add wood or opening the air vents), the combustor can be severely damaged. Flame impinging on a combustor having a porous ceramic substrate can burn a hole through the substrate. In addition, it is well known that the combustion of non-wood fuel such as coal, kerosene, treated wood, painted wood, oil based starters, and artificial logs will "poison" a combustor in the exhaust gas path from such materials by rendering substantial portions or all of the catalytic agent inoperative.

The present invention is directed to providing a new and improved combustor unit having features which eliminate or minimize a number of the foregoing noted deficiencies relative to the incorporating of catalytic combustor units into the exhaust systems of woodburning stoves.

BRIEF SUMMARY OF THE INVENTION

Briefly stated, the present invention in a preferred form is a combustor unit for a woodburning stove comprising a generally T-shaped flue assembly which defines an exhaust gas passageway and an access passageway. A combustor assembly is pivotally mounted in the flue so that a catalytic combustor element can be pivoted between a combustion position wherein the combustor element is positioned across the exhaust passageway and an open position wherein the combustor element is positioned substantially within the access passageway. A seat means is interiorly positioned in the exhaust passageway to define a stop for limiting the pivotal movement of the combustor assembly. A crank arm means engages the combustor assembly and extends exteriorly from the flue to enable the combustor assembly to be pivoted between the combustion position and the open position.

In a preferred form, the combustor element is a porous ceramic substrate of honeycomb configuration with a coating of a noble metal. The combustor is retained in a collar. The crank arm forms a pivot axis interior of the flue for pivoting the combustor. The crank arm means further comprises a crank shaft, mounted through opposite openings of the access passageway, which engages the combustor assembly collar. The combustor assembly may be dismounted by removing the crank handle from the collar. The pivot axis of the combustor assembly is proximate the intersection of the exhaust and access passageways.

A removable cap is received at the end of the access passageway to close-off the passageway. The cap may also include a window for viewing the combustor.

The combustor unit will also preferably comprise a damper pivotally interposed in the exhaust passageway. A temperature gauge for measuring the exhaust gas temperature in the vicinity of the combustor is also provided.

An object of the invention is to provide a new and improved combustor unit for a woodburning stove which combustor unit is adapted to provide for the combustion of exhaust gases.

Another object of the invention is to provide a new and improved combustor unit for a woodburning stove wherein the combustor assembly is relatively easy to remove and/or replace.

Another object of the invention is to provide a new and improved combustor unit for a woodburning stove wherein the combustor unit may be efficiently cleaned while the combustor element is retained within the combustor unit.

A further object of the invention is to provide a new and improved combustor unit for a woodburning stove wherein the combustor element may be pivoted out of the exhaust stream to prevent thermal shock to and flame impingement on the combustor element.

An additional object of the present invention is to provide a retrofit combustor unit which is substantially imune to plugging by fly ash and other materials entrained in the exhaust gas stream since it can be rotated out of the stream until the fire has been started and has become stabilized and self-sustaining.

A further object of the invention is to provide a new and improved combustor unit for a woodburning stove wherein a single combustor unit is adaptable for use both with stoves having a top exhaust and wood stoves having a rear exhaust configuration.

Other objects and advantages of the invention will become apparent from the detailed description and the drawings.

DETAILED DESCRIPTION

Figure 1:
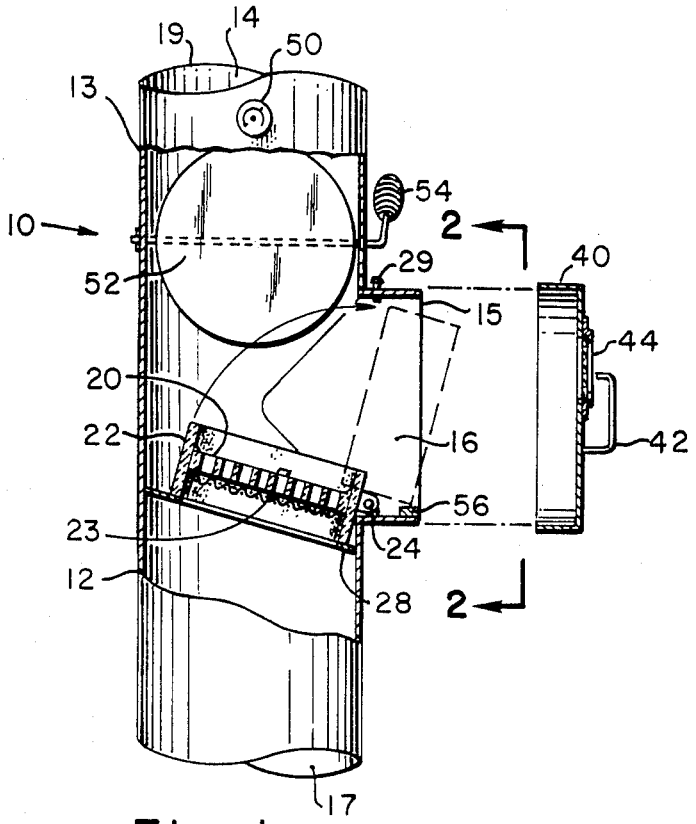
FIG. 1 is a side-sectional view in accordance with a combustor unit of the present invention, partly broken away, partly exploded, and partly in phantom.

With reference to the drawings, wherein like numerals represent like parts throughout the drawings, a combustor unit for a woodburning stove is generally designated by the numeral 10. Combustor unit 10 comprises a T-shaped flue assembly 12 of generally conventional form having an exhaust conduit 13 defining an exhaust passageway 14 and an access conduit 15 defining an access passageway 16 which will typically have its axis at a right angle to the axis of passageway 14. Conduits 13 and 15 may, for example, be on the order of 8 inches in diameter and be constructed of 20 gauge steel. Flue assembly 12 is adapted for incorporation into the exhaust system of a woodburning stove (not illustrated). Exhaust conduit 13 includes an inlet end 17 and an exit end 19. Inlet end 17 is preferably installed as close as possible to the exhaust gas discharge opening of a woodburning stove. In the combustor unit illustrated in FIGS. 1 and 2, the combustor unit connects at inlet end 17 to the exhaust opening of the woodburning stove, the exhaust path being essentially vertical as illustrated in a general upward direction through the exit end 19 of the combustor unit. Combustor unit 10 is adaptable for use both with woodburning stoves having a top or vertical exhaust and woodburning stoves having a rear or side exhaust configuration. Regardless of the stove configuration, combustor unit 10 is adapted so that the exhaust gases from the woodburning stove enter the combustor unit at the inlet end 17 and exit the combustor unit at the exit end 19.

A combustor assembly is pivotally located within flue assembly 12. The combustor element 20 of the combustor assembly is a gas permeable substrate, for example a porous ceramic substrate of honeycomb configuration, having a coating of a noble metal. A suitable combustor is an element marketed by the Corning Glassworks under the trade designation "Corning Wood Stove Combustor." Combustor 20 is tightly received within, but removable from, a ring-like heavy duty collar 22. In the fabrication of the combustor assembly, a screen 23 is first inserted in collar 22, the screen resting against an internal stop, and the combustor element 20 is then installed. The screen 23 will support the pieces should the combustor element 20 shatter for any reason and thus will prevent pieces of the combustor from falling into the fire box. A sleeve-like connector 24 is welded or otherwise affixed to an exterior portion of collar 22.

Figure 2:
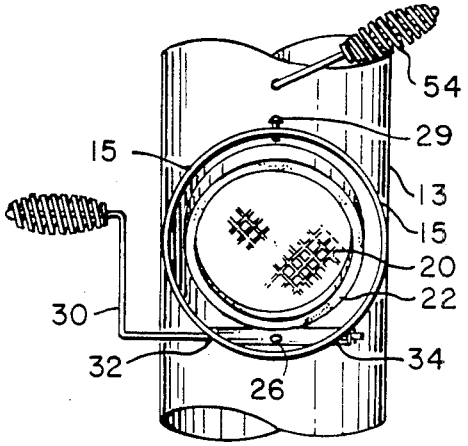
FIG. 2 is a partial end view of the combustor unit of FIG. 1 looking along the line 2—2 of FIG. 1.

A pair of opposed openings 32 and 34 are provided in a lower portion of the access conduit 15 proximate the intersection of the access conduit 15 with the exhaust conduit 13. A crank shaft 30 is received through the opposed openings 32 and 34 and is intermediately slidably received in the sleeve-like portion of connector 24 to pivotally mount the combustor assembly. Crank shaft 30 preferably contains an intermediate flat portion (not shown). A set screw 26 or other suitable locking means threaded into connector 24 engages the flat portion of crank shaft 30 to thereby secure the crank arm in a fixed position relative to connector 24 and hence to the combustor assembly. Crank shaft 30 thus forms a pivot axis for the combustor assembly. With reference to FIG. 2, connector 24 may be dimensioned to tangentially project relative to collar 22 to interiorly abut access conduit 15. The set screw 26, accordingly, axially locates crank shaft 30 and secures the crank arm to the combustor assembly. Crank shaft 30 projects exteriorly from openings 32 and 34 of the flue assembly and is rotatable therein to provide a manual means for rotating or pivoting the combustor assembly.

With reference to FIG. 1, a circumferential seat 28 is interiorly located in the exhaust conduit and rigidly secured to the sides of the exhaust conduit 13. Seat 28 may be a metallic member which is welded in place. Seat 28 is preferably positioned at an angle oblique to the longitudinal axis of conduit 13. Seat 28 may take a variety of forms which function to seat the combustor/-collar assembly and to provide a stop to limit the pivotal movement of the combustor/collar assembly. Combustor 20 is thus pivotal by means of crank shaft 30 between a combustion position as illustrated in FIG. 1, wherein collar 22 rests against seat 28, to an open position (shown in dashed lines), wherein the combustor 20 is substantially located within access passageway 16. While not essential, since the weight of the combustor assembly will retain in the open position when it has been rotated beyond the vertical, a stop 29, in the form of a spring loaded pin in the disclosed embodiment, may be mounted in access conduit 15 to interiorly engage the top of collar to retain the combustor assembly in the open position. Alternately, when the combustor assembly is pivoted to the open position, the edge of the collar may contact a stop 56 on the interior of access conduit 15.

A removable cap 40 is slidably secured at the end of the access conduit to close-off the access passageway. Cap 40 may further include a handle 42 adapted to facilitate the removal of the cap. A window or viewing port 44 is located in the cap so that the combustor 20 may be observed through the window when the combustor is in the combustion position.

A damper 52 of conventional form is also interiorly located in the exhaust passageway 14. A damper handle 54 of conventional form is provided for manual positioning of the damper. Damper 52 may be employed as a means for retaining the combustor/collar assembly in an open position when the combustor unit is employed in a rear (horizontal) exhaust system. The latter may be accomplished by pivoting the damper to engage an edge of collar 22.

A temperature gauge 50 is also preferably provided on the side of the flue assembly. Temperature gauge 50, which includes a probe, is adapted to sense the temperature in the exhaust conduit in the vicinity of the seat 28 and to provide a visual indication of the sensed temperature.

Combustor unit 10 is installed in the exhaust system of a woodburning stove by connecting end 17 as close as possible to th exhaust opening of the woodburning stove. Outlet end 19 is connected to the exhaust conduit which leads to the outside of the space to be heated. After the woodburning stove has been started, and combustor element 20 has warmed up by heat transfer from the exhaust gases, the assembly is pivoted to the combustion position illustrated in FIG. 1. The exhaust gases generated by the combustion of the wood are brought into contact with the noble metal catalyst coated on the combustor. The combustor 20 may assume a variety of forms other than the aforementioned honeycomb configuration, which configurations are dictated by the design objective of providing a relatively large contact surface per unit volume of the exhaust gases. The catalyst acts to facilitate combustion of the exhaust gases at a relatively low temperature. The combustor 20 is normally operative to combust the exhaust gases at temperatures in the range of approximately 500 degrees F. to 2000 degrees F. The damper 52 is generally pivoted to a restricted position to decrease the rate of escape of the exhaust gases through the exhaust system thus maintaining the combustor within its operating temperature range. The combustion of the exhaust gases in the latter temperature range acts to prevent creosote deposits and the formation of other pollutants. The combustor essentially ignites creosote and pollutant-forming gases at about one-half the temperature which would normally be required to burn such gases. The combustor in the operational combustion mode not only acts to remove creosote from the exhaust, but also may increase the quantity of usable heat produced by the stove and provide a cleaner exhaust stream.

At higher temperatures, the combustor will glow a bright cherry-red color. The glow from the combustor can be viewed through the viewing port 44. Temperature gauge 50 may also be employed to monitor the temperature in the vicinity of combustor 20 to thereby determine whether the combustor unit is operational to combust the exhaust gases.

Combustor elements which employ a catalyst on a ceramic substrate to facilitate combustion of exhaust gases from woodburning stoves, such as combustor 20, are very susceptible to thermal shock. Cold currents may crack the ceramic substrate and thus permanently render the combustor inoperable if such currents impinge on the combustor when the combustor is being operated at a relatively high temperature. Such cold currents are frequently produced when additional fuel is added to the woodburning stove and/or air vents are opened to increase the combustion rate of the fuel. Ceramic substrate combustors are also susceptible to damage, particularly burn through, as a result of flame impingement thereon. In accordance with one feature of the invention, combustor unit 10 is specifically adapted to minimize and/or eliminate the adverse effects to combustor 20 due to flame impingement and/or thermal shock. The latter is accomplished by providing an efficient means to pivot the combustor element out of the exhaust passageway when the air vents of the stove are opened or the stove is opened to replenish the fuel supply or other conditions are present that result in relatively cold gas traversing exhaust passageway 14. Accordingly, when the latter conditions occur, the combustor element may be pivoted out of the exhaust passageway 14 by manual rotation, i.e., by pivoting of crank shaft 30, so that the combustor element is brought to the open position illustrated by the dashed lines in FIG. 1. Thus, thermal shock of and flame impingement on the combustor can be substantially eliminated.

Combustor 20 may also be efficiently cleaned without removing the combustor from combustor unit 10. The cleaning is accomplished by banging the collar 22 against seat 28 to dislodge particulate matter which has been deposited on or in the combustor element. Naturally, the seat 28 must be relatively rigidly affixed to the exhaust conduit. Banging the frame against the seat may be easily accomplished by a succession of forceful reciprocating strokes manually applied to the crank arm 31.

The combustor element may also be efficiently removed from the combustor unit. To facilitate removal, the removable cap 40 is slidably removed from the end of access conduit 15. The combustor assembly is pivoted to the open position. Set screw 26 is removed from connector 24 and crank shaft 30 is withdrawn from the connector and the openings in the access conduit. The combustor/collar assembly is thus dismounted and may be relatively easily manually removed from the combustor unit through the access passageway. From the foregoing, it may be appreciated that combustor unit 10 provides a relatively easy and efficient means to remove and/or replace a combustor element 20.

In a preferred form, the combustor element when in the combustion position is oriented so that the combustor 20 is disposed at an angle which is oblique to the longitudinal axis of the exhaust conduit to permit using combustor unit 10 with either a top or rear wood stove exhaust system configuration. In a rear exhaust configuration exhaust conduit 13 is mounted so that the longitudinal axis thereof is substantially horizontal, rather than the vertical orientation illustrated in the drawings. In this latter orientation, damper 52 may be employed to retain the combustor/collar frame assembly when the latter assembly is pivoted to the open position. An additional feature of the invention is that in the event of a rapid combustion or explosion in the woodburning stove, combustor 20 will be forced to an open position. This latter feature results regardless of whether combustor unit 10 is installed to a top or rear exhaust.

While a preferred embodiment of the foregoing combustor unit has been set forth for purposes of illustration, the foregoing description should not be deemed a limitation of the present invention. Accordingly, various alternatives, modifications, and adaptations of the combustor unit of the present invention may occur to one skilled in the art.

What is claimed is:

1. A combustor unit for a wood stove comprising:

a flue assembly defining an exhaust passageway having an axis and an access passageway having an axis which intersects the exhaust passageway axis at an angle, the junction of said passageways defining a plane;

combustor means pivotally mounted in said flue assembly, said combustor means being pivotal between a combustion position wherein said combustor means is positioned across said exhaust passageway and an open position wherein said combustor means is positioned substantially within said access passageway;

a seat means interiorly positioned in said exhaust passageway to define a stop for limiting pivotal movement of said combustor means; and crank means extending exteriorly from said flue assembly and affixed to said combustor means to manually pivot said combustor means.

2. The combustor unit of claim 1 wherein said combustor means includes a gas permeable substrate with a coating of a noble metal and support means for said substrate.

3. The combustor unit of claim 1 wherein said crank means forms a pivot axis for said combustor means, said crank means being mounted through opposed openings in the side of said access passageway to intermediately mount said combustor means.

4. The combustor unit of claim 3 wherein the crank means comprises a crank shaft pivotally mounting said combustor means, said combustor means being removable from the combustor unit by slidably removing said crank shaft from the combustor unit and manually removing the combustor through the access passageway.

5. The combustor unit of claim 3 wherein the pivot axis is proximate the plane of intersection of the exhaust and access passageways.

6. The combustor unit of claim 1 further comprising a removable cap received at the end of the access passageway to close off the passageway.

7. The combustor unit of claim 6 wherein the cap includes a window for viewing the combustor means.

8. The combustor unit of claim 1 further comprising temperature sensor means to measure the temperature in said exhaust passageway in the vicinity of said seat means.

9. The combustor unit of claim 1 further comprising damper means pivotally interposed in said exhaust passageway.

10. The combustor unit of claim 9 further comprising catch means to secure the combustor means in the open position.

11. The combustor unit of claim 10 wherein said catch means is said damper.

12. The combustor unit of claim 1 wherein the seat means is positioned so that the combustion position of the combustor means is oriented obliquely with respect to the axis of said exhaust passageway.

13. The combustor unit of claim 1 wherein the combustor means includes a combustor element mounted in a collar, said collar having a sleeve-like projection for receiving said crank means.

14. The combustor unit of claim 1 wherein the flue assembly is substantially T-shaped.

15. A catalytic combustor retrofit unit for a wood stove comprising:

a generally T-shaped flue assembly including an exhaust conduit and an access conduit;

combustor means to facilitate the combustion of exhaust gases by catalytic means, said combustor means including a combustor element mounted in a collar, said collar being pivotally supported in said access conduit, said combustor means being pivotally positionable in a combustion position wherein the combustor means is substantially positioned within the exhaust conduit and an open position wherein the combustor means is substantially positioned within the access conduit; and crank means extending exteriorly from said flue assembly to manually pivot said combustor means.

16. The combustor unit of claim 15 further comprising seat means mounted in said exhaust conduit, said seat means being located and shaped to be contacted by said collar in the combustion position of said combustor means whereby said means will be supported by said seat means.

17. The combustor unit of claim 16 further comprising damper means located in said exhaust conduit downstream of said seat means and pivotally positionable to restrict the flow rate of exhaust gases through said combustor means.

18. The combustor unit of claim 17 wherein the combustor means in the combustion position is oriented obliquely relative to the exhaust conduit.

* * * * *